US005797321A

United States Patent [19]

Shibata

[11] Patent Number: 5,797,321

[45] Date of Patent: Aug. 25, 1998

[54] PAPER GUIDE APPARATUS FOR SHEET-FED OFFSET PRINTING PRESS

[75] Inventor: Satoshi Shibata, Ibaragi, Japan

[73] Assignee: Komori Corporation, Tokyo, Japan

[21] Appl. No.: 898,581

[22] Filed: Jul. 22, 1997

[30] Foreign Application Priority Data

Jul. 23, 1996 [JP] Japan ..... 8-193125

[51] Int. Cl.[6] ..... B41F 21/00

[52] U.S. Cl. ..... 101/246; 101/409; 271/197; 271/204

[58] Field of Search ..... 101/246, 232, 101/409, 420; 271/197, 204, 85

[56] References Cited

U.S. PATENT DOCUMENTS 5,228,391 7/1993 DeMoore et al. ..... 101/420
5,263,415 11/1993 Pollich ..... 101/232
5,497,987 3/1996 Henn et al. ..... 27/204

FOREIGN PATENT DOCUMENTS

0527453A1 8/1992 European Pat. Off. .
63-64748 3/1988 Japan .
6-144682 5/1994 Japan .

*Primary Examiner*—Christopher A. Bennett
*Attorney, Agent, or Firm*—Blakely Sokoloff Taylor & Zafman

[57] ABSTRACT

A paper guide apparatus for a sheet-fed offset printing press includes a conveying unit, a gripper unit, a paper guide member, and an inspection unit. The conveying unit conveys a printed sheet delivered from a printing unit. The gripper unit is supported by the conveying unit for gripping one end of the sheet. The gripper unit has a plurality of sets of grippers and gripper pads. The paper guide unit is arranged along a sheet conveying route to guide the sheet which is being conveyed with a guide surface arranged to be substantially flush with the gripper pads. The paper guide member has a plurality of suction holes for drawing the sheet on the guide surface by suction and a plurality of grooves formed on traveling routes of the grippers. The inspection unit inspects a printed state of the sheet which is conveyed while being drawn on the guide surface of the paper guide unit by suction.

7 Claims, 4 Drawing Sheets

PAPER GUIDE APPARATUS FOR SHEET-FED OFFSET PRINTING PRESS

BACKGROUND OF THE INVENTION

The present invention relates to a sheet-fed offset printing press having an inspection unit for detecting a misfed sheet.

Generally, in a sheet-fed offset printing press of this type, a sheet conveyed by delivery chains is inspected by an inspection unit provided in a delivery unit continuing to a printing unit, thereby inspecting the printed state of the sheet which has been printed by the printing unit. For proper inspection, measures must be taken to regulate swing of sheets, i.e., so-called instability of sheets conveyed by the delivery chains, and winding of sheets, i.e., so-called curling of sheets, which result in wave and roll of sheets, respectively. A sheet-fed web offset printing press having such measures is proposed in FIG. 3 of Japanese Patent Laid-Open No. 63-64748.

In this proposed sheet-fed web offset printing press, a frame is added in the delivery unit. In addition, a support plate functioning as a sheet stabilization means is arranged in this frame in correspondence with the inspection unit such that a sheet conveyed by the delivery chains having a plurality of gripper bars provided at a predetermined interval is brought into contact with the frame.

In the above-described conventional sheet-fed offset printing press, a gap must be formed between the support plate and the distal ends of the grippers of the gripper bar for holding the sheet such that the support plate and the grippers do not interfere with each other during the traveling operation of the delivery chains. A sheet which has passed between the blanket cylinder and the impression cylinder of the final printing unit becomes instable or is curled due to the printing pressure from the blanket cylinder and the impression cylinder. When a gap is formed between the support plate and the gripper bar, the trailing edge of the sheet with instability or curling is separated from the support plate by a distance corresponding to the gap while the sheet is being gripped by the grippers of the gripper bar and conveyed. For this reason, the instability or curling of the sheet to be inspected by the inspection unit cannot be sufficiently corrected, resulting in a decrease in inspection accuracy of the inspection unit.

SUMMARY OF THE INVENTION

It is an object of the present invention to provide a sheet-fed offset printing press having an inspection unit with an improved inspection accuracy.

In order to achieve the above object, according to the present invention, there is provided a paper guide apparatus for a sheet-fed offset printing press, comprising conveying means for conveying a printed sheet delivered from a printing unit, a gripper unit, supported by the conveying means for grip one end of the sheet, the gripper unit having a plurality of sets of grippers and gripper pads, a paper guide unit arranged along a sheet conveying route to guide the sheet which is being conveyed with a guide surface arranged to be substantially flush with the gripper pads, the paper guide unit having a plurality of suction holes for drawing the sheet on the guide surface by suction, and a plurality of grooves formed on traveling routes of the grippers, and inspection means for inspecting a printed state of the sheet which is conveyed while being drawn on the guide surface of the paper guide unit by suction.

DESCRIPTION OF THE PREFERRED EMBODIMENT

An embodiment of the present invention will be described below in detail with reference to the accompanying drawings.

Figure 4:
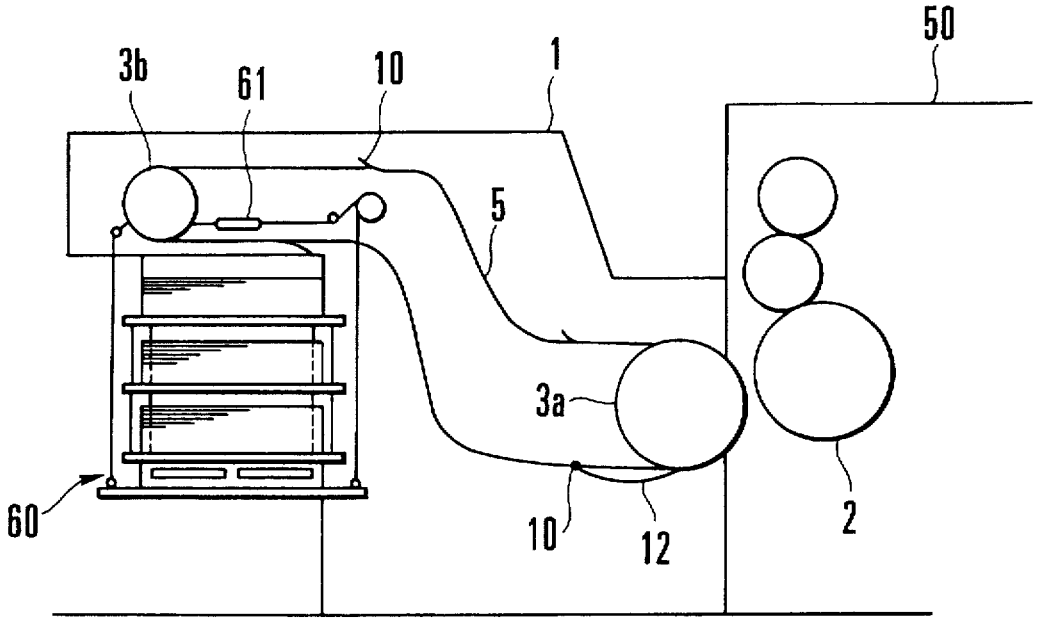
FIG. 4 is a schematic view showing the arrangement of a delivery apparatus for a sheet-fed offset printing press according to an embodiment of the present invention.

FIG. 4 shows the schematic arrangement of a delivery apparatus for a sheet-fed offset printing press according to an embodiment of the present invention. Referring to FIG. 4, reference numeral 1 denotes a sheet conveying unit constituting the delivery apparatus. A printing unit 50 having an impression cylinder 2 is arranged upstream in the sheet conveying direction of the sheet conveying unit 1. A pile board 60 on which a printed sheet 12 is stacked is arranged downstream in the sheet conveying direction of the sheet conveying unit 1. A pair of left and right sprockets 3*a* are arranged at an end upstream in the sheet conveying direction of the sheet conveying unit 1. A pair of left and right sprockets 3*b* are arranged at an end downstream in the sheet conveying direction of the sheet conveying unit 1. A pair of left and right delivery chains 5 as conveying means extend between the sprockets 3*a* and 3*b*. When the sprockets 3*a* rotate, the delivery chains 5 having grippers 10 travel in the direction for delivering the sheet 12.

In the delivery apparatus with the above arrangement, the sheet 12 with its leading edge being gripped by the grippers 10 of the delivery chains 5 is delivered from the impression cylinder 2 of the printing unit 50 and conveyed onto the pile board 60 through the sheet conveying unit 1. When the grippers 10 are opened by a cam mechanism 61, the sheet 12 conveyed onto the pile board 60 is released and stacked on the pile board 60.

Figure 1:
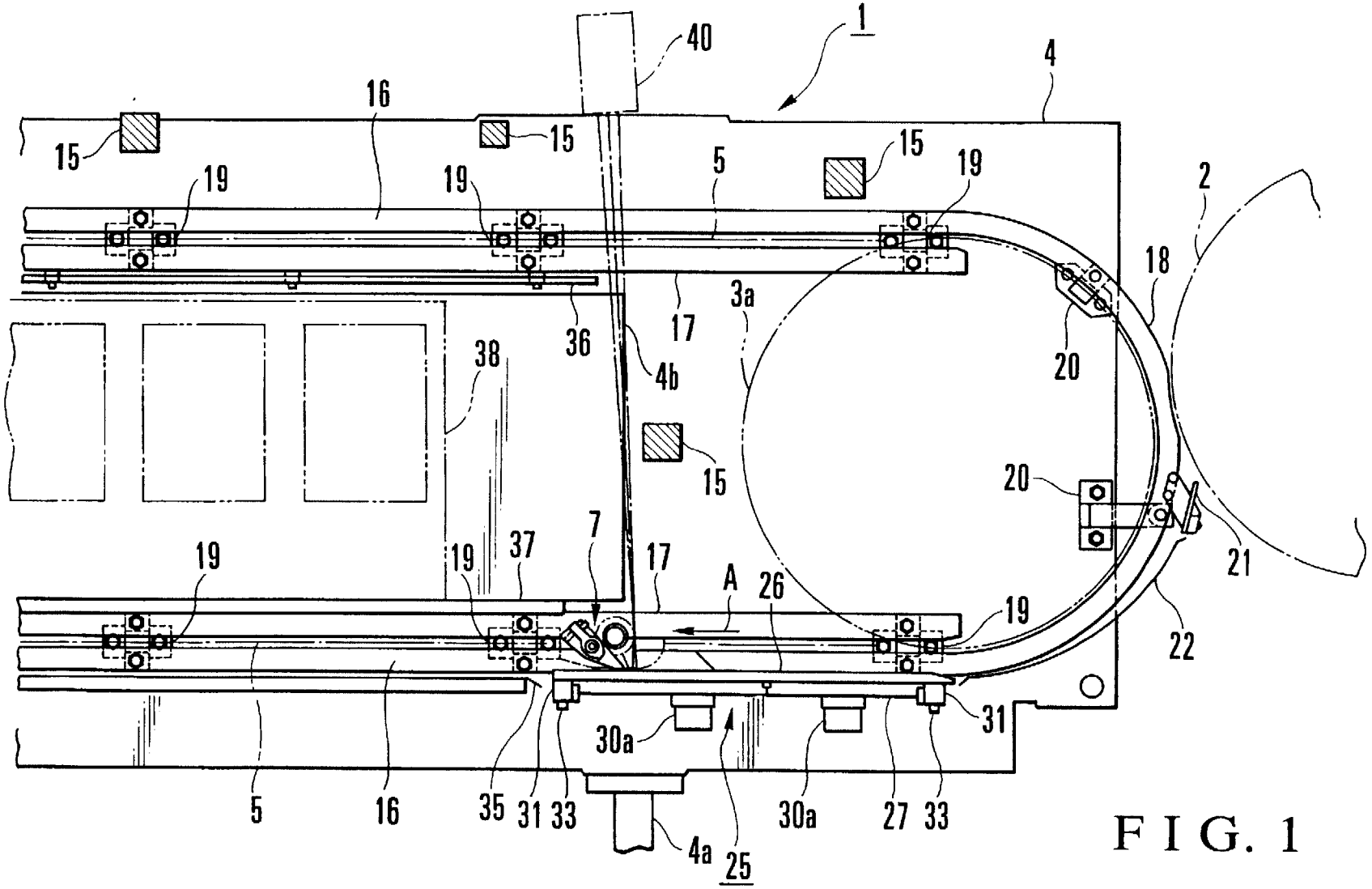
FIG. 1 is an enlarged side view showing the main portion of a sheet conveying unit shown in FIG. 4.

FIG. 1 shows the main portion of the sheet conveying unit 1 shown in FIG. 4. Referring to FIG. 1, the sheet conveying unit 1 has a pair of left and right delivery frames 4 each standing on the floor base through a column 4*a* and having a rectangular window 4*b*. The above-described sprockets 3*a* and 3*b* are rotatably supported by the pair of delivery frames 4 through bearings. Rotation of a motor is transmitted to the delivery chains 5 through a driving gear 6 (FIG. 2) axially mounted on the shaft of the sprockets 3*a* so that the delivery chains 5 travel in the sheet conveying direction indicated by an arrow A.

Figure 3:
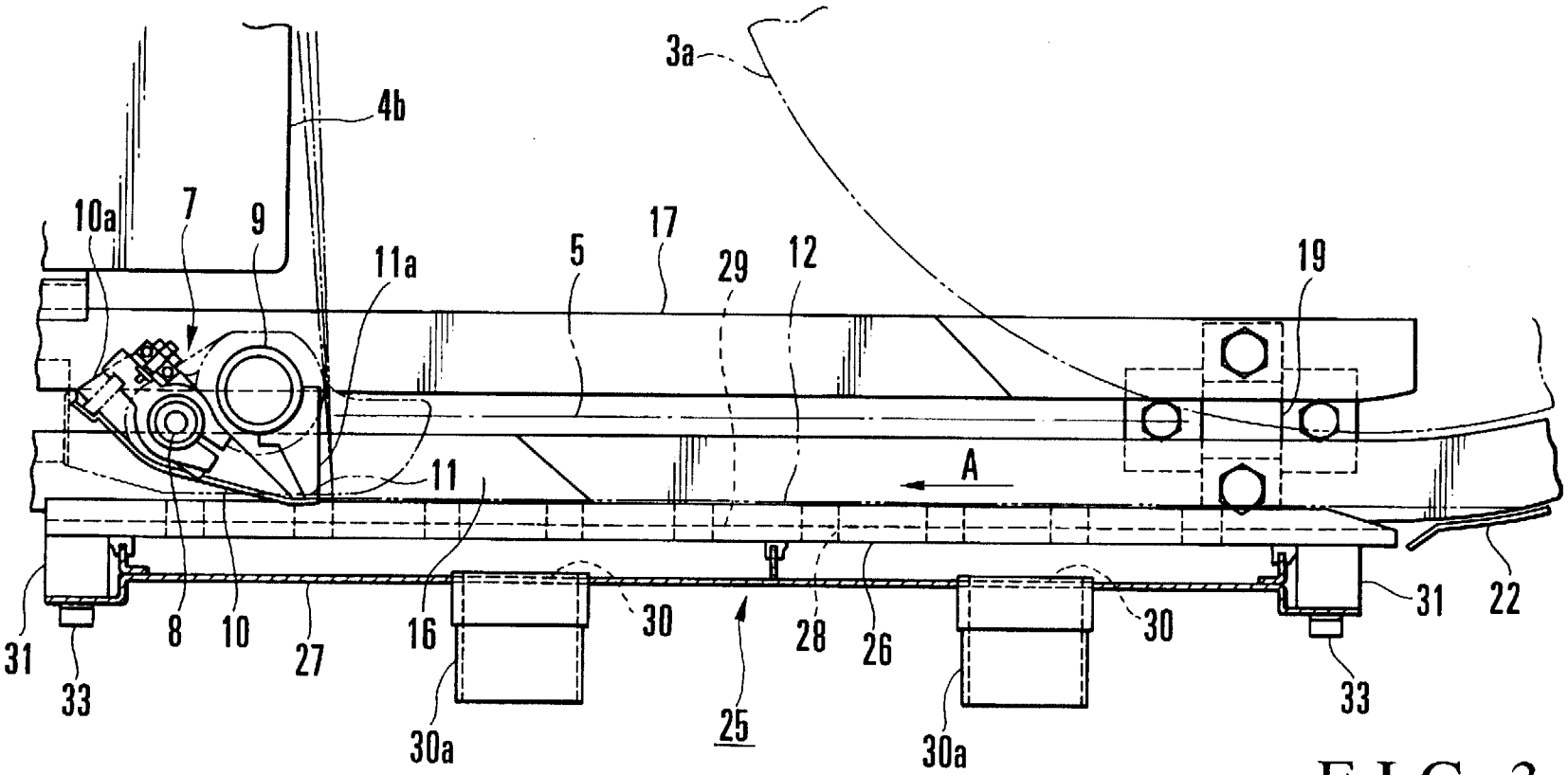
FIG. 3 is an enlarged side view showing the main portion of the sheet conveying unit shown in FIG. 1.

A plurality of gripper bars 7 each having the above-described grippers 10 are arranged between the pair of delivery chains 5 at a predetermined interval in the conveying direction of the sheet 12. As shown in FIG. 3, each of the gripper bars 7 is constituted by a gripper shaft 8 and a gripper pad shaft 9 which are axially and parallelly held by the delivery chains 5, and the plurality of grippers 10 and a plurality of gripper pads 11 which are arranged through holders 10*a* and 11*a* on the axes 8 and 9, respectively, to oppose each other. The sheet 12 delivered from the impression cylinder 2 of the printing unit 50 is gripped by the grippers 10 and the gripper pads 11 and conveyed by the delivery chains 5 traveling in the direction indicated by the arrow A.

A plurality of tie-bars 15 span between the delivery frames 4. Guide rails 16 and 17 are fixed on the upper and lower sides of the delivery frames 4 through stepped studs 19 such that the delivery chains 5 are guided between the rails 16 and 17. A pair of left and right semicircular guide rails 18 are fixed on the left and right delivery frames 4, respectively, through stepped studs 20 along the outer circumferences of the sprockets 3*a*.

Reference numeral 21 denotes a missing sheet regulation member fixed to the guide rails 18. The missing sheet regulation member 21 is arranged below the opposing position of the sprockets 3*a* and the impression cylinder 2 to prevent the sheet 12, that the grippers 10 of the gripper bar 7 have failed to grip, from falling in the apparatus. A plurality of paper guides 22 each having an arcuate section are arranged between the delivery frames 4 at a predetermined interval. The paper guides 22 are separated from the outer circumferences of the sprockets 3*a* by a predetermined distance and regulate the instability of the trailing edge of the sheet 12 transferred from the grippers of the impression cylinder 2 to the grippers 10 of the gripper bar 7.

Figure 2:
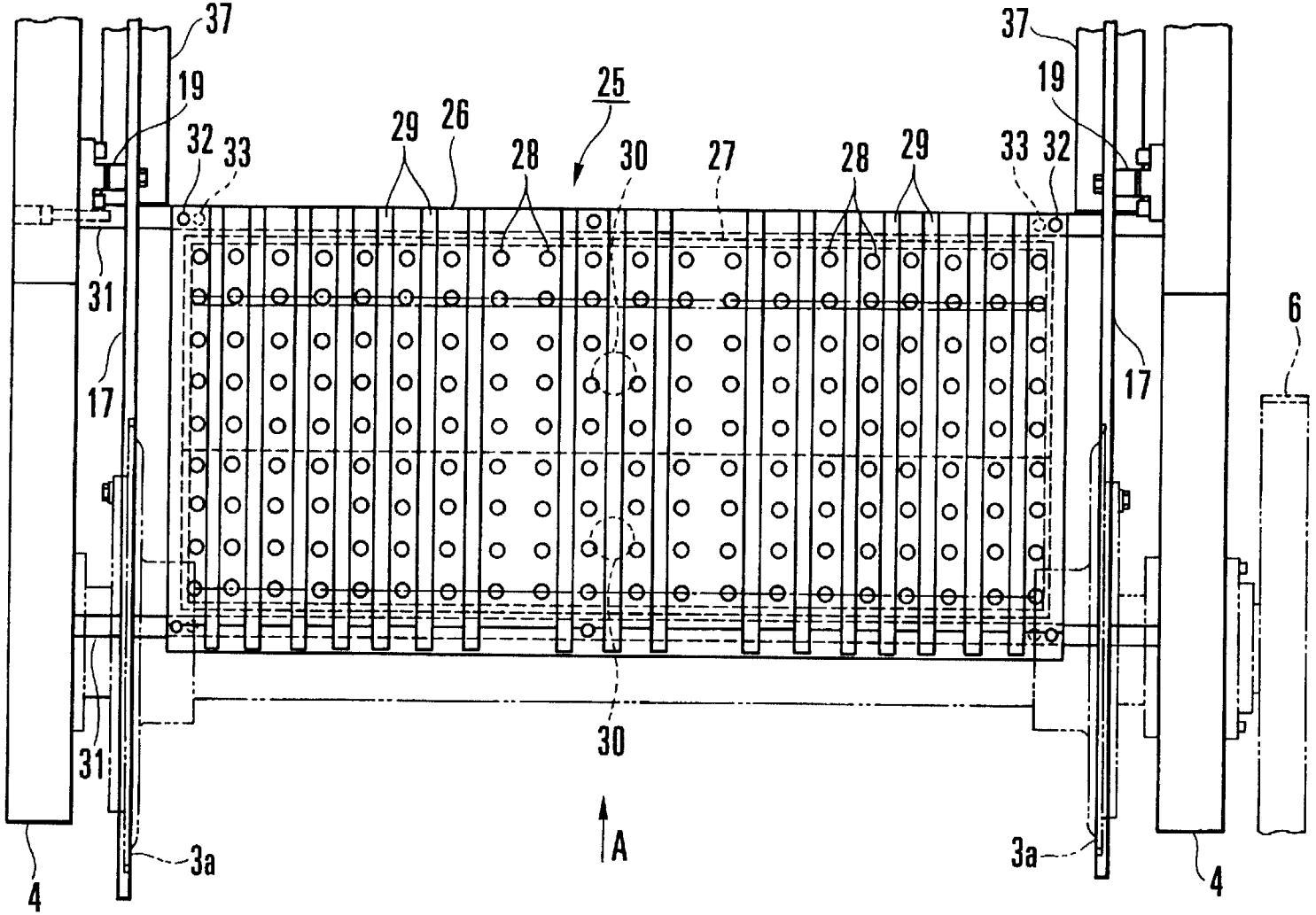
FIG. 2 is a plan view showing the paper guide unit portion of the sheet conveying unit shown in FIG. 1.

As shown in FIG. 3, a paper guide unit 25 having a paper guide plate 26 and a suction box 27 is horizontally arranged under the delivery chains 5 while being separated from the delivery chains 5 by a predetermined distance over the range where an inspection unit 40 (to be described later) inspects the printed surface of the sheet 12. The paper guide plate 26 has a rectangular and flat plate shape extending between the sprockets 3*a*. The paper guide plate 26 has a plurality of suction holes 28 extending therethrough, and a plurality of grooves 29 formed in correspondence with the grippers 10 of the gripper bars 7 to be parallel to the sheet conveying direction indicated by the arrow A, as shown in FIG. 2. Each groove 29 has a width larger than that of the distal end portion of the gripper 10 and a depth larger than the entering length of the distal end portion of the gripper 10. With this arrangement, the distal end portion of each gripper 10 is prevented from contacting both walls and the bottom surface of the corresponding groove 29 during traveling.

The suction box 27 consisting of a shallow tray-like plate member is divided into two pieces in a direction perpendicular to the sheet conveying direction and arranged in correspondence with the paper guide plate 26. A suction port 30 is formed substantially at the center of each divided box. A connection member 30*a* is provided on the suction port 30 to connect the suction port 30 to a suction air source through a pipe (not shown).

The paper guide plate 26 is fixed, with bolts 32, to tie-bars 31 fixed between the delivery frames 4 with bolts such that the grooves 29 correspond to the traveling routes of the grippers 10 of the gripper bars 7, and the surface of the paper guide plate 26 becomes flush with the gripping surface of the gripper pads 11.

The suction box 27 is hermetically fixed, under the paper guide plate 26, to the tie-bars 31 with bolts 33 such that the upper opening portion of the suction box 27 is closed by the lower surface of the paper guide plate 26.

A plurality of juxtaposed paper guides 35 are horizontally attached between the delivery frames 4 to be continued from the downstream end portion of the paper guide unit 25 along the sheet conveying direction.

Reference numeral 36 denotes a grease receiving tray fixed to the lower portion of the upper guide rail 17 with bolts. Reference numeral 38 denotes a dryer unit fixed, above the paper guides 35, to a rest 37 attached between the delivery frames 4. The dryer unit 38 can be extracted/inserted through the window 4*b* of the delivery frame 4. The inspection unit 40 is fixed on the upper end faces of the delivery frames 4 through a bracket (not shown) to detect the printing density value of the printed surface of the sheet 12 conveyed on the paper guide plate 26.

The operation of the delivery apparatus having the above arrangement will be described next. The sheet 12 printed by the printing unit 50 is transferred from the grippers of the impression cylinder 2 to the grippers 10 and the gripper pads 11 of the gripper bar 7 and conveyed onto the paper guide plate 26 of the sheet conveying unit 1 by the delivery chains 5. Since the traveling routes of the grippers 10 correspond to the grooves 29 of the paper guide plate 26, the grippers 10 enter the grooves 29, although the gripping surface of the gripper pads 11 is flush with the surface of the paper guide plate 26. Therefore, the grippers 10 or the gripper pads 11 do not interfere with the paper guide plate 26.

When the gripping surface of the gripper pads 11 and the surface of the paper guide plate 26 are flush with each other, the surface of the conveyed sheet 12 gripped by the grippers 10 of the gripper bar 7 is also flush with the surface of the paper guide plate 26. For this reason, no gap is formed between the sheet 12 and the paper guide plate 26. When the suction air source (not shown) is actuated to evacuate the suction box 27 to a negative pressure, air on the surface of the paper guide plate 26 is drawn into the suction box 27 by suction through the suction holes 28, so that the conveyed sheet 12 is drawn on the surface of the paper guide plate 26 by suction.

Even when the sheet 12 transferred from the grippers of the impression cylinder 2 to the grippers 10 of the gripper bar 7 is unstable or curled, the sheet 12 is conveyed on the paper guide plate 26 while being drawn on the surface of the paper guide plate 26 by suction and kept flush with the surface of the paper guide plate 26. For this reason, the instability or curling of the sheet 12 is eliminated on the surface of the paper guide plate 26, and the sheet 12 is conveyed on the surface of the paper guide plate 26 while being kept taut. Consequently, the sheet 12 can be always stably inspected by the inspection unit 40 one by one under the same conditions, and highly accurate inspection is performed.

The inspection unit 40 detects the printing density value of the printed surface of the sheet 12 one by one, and, when the detected value differs from the density value of the standard image due to smear, setoff, misregistration or the like, outputs a misfed sheet detection signal. This detection signal is sent to the gripping releasing unit of the paper guide apparatus via, e.g., a delay circuit and used as a control signal for delivering the misfed sheet whose printed surface is being dried by the dryer unit 38 to a route different from that to the pile board 60 on which normal papers are stacked. Alternatively, the detection signal is used as a control signal for inserting a tape under the misfed sheet stacked on the pile board 60 to discriminate the misfed sheet from normal sheets.

In this embodiment, inspection by the inspection unit 40 is performed during the traveling operation by the delivery chains 5, i.e., after the printing operation of the printing unit 50 is complete. However, when sheet transfer chains are employed between a plurality of continuous printing units in place of transfer cylinders, and the paper guide unit 25 is arranged near the sheet transfer chains, inspection can be performed after the printing process of each printing unit.

In this embodiment, inspection by the inspection unit 40 is performed at the horizontal traveling portion of the delivery chains 5, and accordingly, the horizontal and flat paper guide unit 25 is used. However, when the traveling route of the delivery chains 5 is tilted, the paper guide unit 25 may be tilted. That is, the paper guide unit 25 only need be parallel to the traveling route of the delivery chains 5. The suction holes 28 are formed in the surface of the paper guide plate 26. However, the suction holes 28 may be formed in the grooves 29 or in both the grooves 29 and the surface of the paper guide plate 26.

As has been described above, according to the present invention, the target inspection sheet is conveyed while being chucked on the guide surface of the paper guide member. The instability or curling of the target inspection sheet is corrected to a flat and taut state on the guide surface of the paper guide member. For this reason, the target inspection sheet can always be stably inspected by the inspection unit one by one under the same conditions, and highly accurate inspection can be performed.

In addition, since the target inspection sheet is drawn on the guide surface of the paper guide member by suction while being kept flush with the guide surface, the target inspection sheet can be more properly inspected by the inspection unit. Furthermore, the target inspection sheet can be made flat on the guide surface of the paper guide member using the simple structure of the paper guide plate and the suction box.

What is claimed is:

1. A paper guide apparatus for a sheet-fed offset printing press, comprising:

conveying means for conveying a printed sheet delivered from a printing unit;

a gripper unit, supported by said conveying means for gripping one end of said sheet, said gripper unit having a plurality of sets of grippers and gripper pads, said gripper pads having a paper gripper surface coupled to said gripper to grip said sheet;

a paper guide unit having a guide surface, said paper guide unit arranged along a sheet conveying route to guide said sheet which is being conveyed with said guide surface arranged to be substantially flush with said paper gripper surface of said gripper pads, said paper guide unit having a plurality of suction holes for drawing said sheet on said guide surface by suction, and a plurality of grooves formed on traveling routes of said grippers; and inspection means for inspecting a printed state of said sheet which is conveyed while being drawn on said guide surface of said paper guide unit by suction.

2. An apparatus according to claim 1, wherein the suction holes comprise a lot of small holes formed on said guide surface of said paper guide unit.

3. An apparatus according to claim 2, wherein the suction holes are formed on said guide surface of said paper guide unit excluding insides of the grooves.

4. An apparatus according to claim 2, wherein the suction holes are formed on said guide surface of said paper guide unit including insides of the grooves.

5. An apparatus according to claim 1, wherein said paper guide unit comprises;

a flat paper guide plate having an upper surface and a lower surface, said flat paper guide plate having grooves formed on said upper surface as said guide surface and the suction holes extending from said upper surface to said lower surface, and a suction box arranged under said paper guide plate to cover the suction holes and draw air by suction through the suction holes.

6. An apparatus according to claim 1, wherein the groove has a width larger than that of a distal end portion of said gripper and a depth larger than an entering length of said distal end portion of said gripper.

7. An apparatus according to claim 1, wherein said conveying means comprises a pair of delivery chains arranged at an interval larger than a width of said sheet, and said paper guide unit is arranged between said delivery chains.

* * * * *